United States Patent [19]

Moore, III

[11] Patent Number: 4,837,913

[45] Date of Patent: Jun. 13, 1989

[54] EMBROIDERY FRAME PRESS PLUNGER HEAD

[76] Inventor: Edgar F. Moore, III, 4447 Old Randleman Rd., Greensboro, N.C. 27405

[21] Appl. No.: 62,086

[22] Filed: Jun. 15, 1987

[51] Int. Cl.[4] ..... B23P 11/02

[52] U.S. Cl. ..... 29/238; 100/295; 38/102.2

[58] Field of Search ..... 29/251, 244, 252, 255, 29/448, 238, 525, 235, 559, DIG. 42; 100/295; 38/102.2

[56] References Cited

U.S. PATENT DOCUMENTS 3,543,371 12/1970 Leavens et al. ..... 29/243.52 X 4,372,156 2/1983 Meismer ..... 29/251 X

*Primary Examiner*—Timothy V. Eley

[57] ABSTRACT

An embroidery frame press plunger head and method is presented which includes a pretension member which allows greater efficiency and uniformity in framing cloth for embroidering or for other purposes. The pretension member is affixed to and extends below the hoop retainer to initiate contact with the cloth or other material to hold it tightly against a work table prior to the sandwiching action of the first and second embroidery hoops. The pretension member consists of an annular shape or other configuration which will hold the cloth securely against the work table.

10 Claims, 3 Drawing Sheets

EMBROIDERY FRAME PRESS PLUNGER HEAD

BACKGROUND OF THE INVENTION

1. Field Of The Invention

The present invention relates to a device and method for improving the efficiency, quality and production of framing cloth or other materials for subsequent embroidering, sewing or other operations.

2. Description Of The Prior Art And Objectives Of The Invention

Framing of textile materials for embroidering, needlepoint, cross stitching and other operations has been done for many years by hand in which the desired material such as a cotton cloth was placed over a base hoop formed from wood, metal or other suitable materials. A hoop having a smaller diameter referred to as the inner hoop is then forced manually into the outer base hoop with the cloth sandwiched between to form a relatively tight frame or surface area of cloth which extends over the inner hoop for application of a logo or the like, for example by embroidering. In recent years, machinery has replaced hand framing operations such as described in my previous U.S. Pat. No. 4,538,335 whereby an embroidery frame press is presented which allows for greater production and uniformity in forming frames of cloth. While such frame presses greatly improve production speeds, additional problems still exist in the framing of cloth regarding the resulting tension of the framed cloth and its quality since wrinkles and blemishes can appear on the area of cloth to be embroidered.

Thus, with the knowledge and understanding of the shortcomings of conventional framing methods, the present invention was conceived and one of its objectives is to improve the speed, efficiency and consistency of cloth which is temporarily framed for embroidering, stitching or other purposes.

It is another objective of the present invention to provide a device and method which will prevent wrinkles during framing and will therefore ensure a uniform, high quality surface area for embroidering or otherwise.

It is also an objective of the invention to provide a plunger head with an adjustable resiliently attached pretension member and method which can be used on conventional embroidery frame presses or which can be used by hand as desired to increase and provide more consistency in the tension of the framed cloth.

It is yet another objective of the present invention to provide a plunger head which allows the user to have a better view of the cloth being framed while the framing takes place thus preventing wrinkles or blemishes from being within the area of cloth of subsequent embroidering.

Other objectives and advantages of the present invention will become apparent to those skilled in the art as a more detailed description is presented below.

SUMMARY OF THE INVENTION

The aforesaid objectives are realized by providing a plunger head with transparent hoop retaining means and having attached thereto an adjustable pretension member which may consist of an annular ring or otherwise which will contact the cloth first, before the retained hoop to grip the cloth tightly against the base hoop or work table. Then, as the plunger head descends further the method and apparatus which allows the cloth to first be contacted by the pretension member forces the retained hoop affixed to the hoop retaining means into engagement with the base hoop with the cloth therebetween. The cloth is thus tightly and uniformly framed. Once such framing of the cloth is then complete, the hoop retaining means is withdrawn from the inner hoop and after another short, predetermined distance of upward movement of the plunger head, the pretension member is also lifted from the cloth leaving a frame of cloth which is tightly and uniformly tensioned. The pretension member allows inner and outer hoops to more tightly sandwich the cloth between said hoops while permitting the inner hoop to easily release from the hoop retaining means since the cloth is held against the work table during initial upward movement of the hoop retaining means by the pretension member. Additional frames of cloth can be consistently produced in this manner without worker fatigue that may cause inconsistency in framing during the later hours of the work shift when the strength, vision, and judgment of workers are not as keen.

DESCRIPTION OF THE PREFERRED EMBODIMENTS

Figure 1:
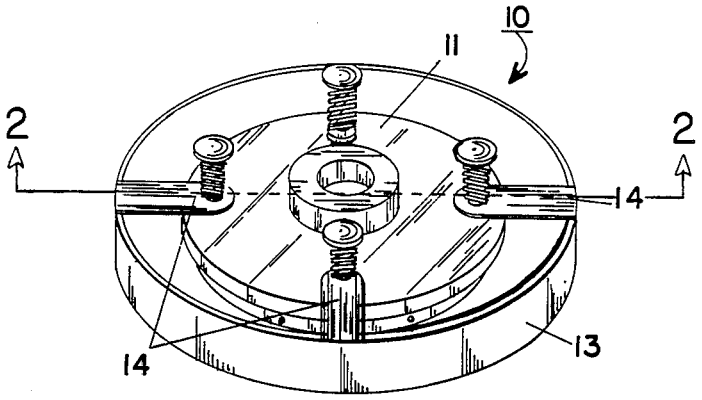
FIG. 1 demonstrates in a perspective fashion a plunger head with a pretension member resiliently attached thereto.

The preferred form of the invention is shown in FIG. 1 in which a plunger head for use with a conventional embroidery frame press is presented. The plunger head includes a transparent hoop retaining means and an annular pretension member which is resiliently joined thereto. As is perhaps better seen in FIG. 2, the pretension member is resiliently adjustably attached to the hoop retaining means by mounting studs having coil springs thereon. The pretension member includes mounting tabs which extend inwardly for attachment to the hoop retaining means. The retaining means is formed from a transparent substance such as polycarbonate, acrylic or other suitable transparent materials and allows the operator prior to framing to quickly observe wrinkles or blemishes on the selected area of cloth.

The preferred method of the invention includes framing cloth for embroidering by placing the cloth at the desired position on a work table or the like over a base hoop. Thereafter, the plunger head with its hoop retaining means and having attached a pretension member that is aligned with the base hoop on the work table, is lowered thereby contacting the cloth first with the pretension member to hold it firmly against the work table. The hoop retaining means with hoop continues its downward descent and the cloth is thereby sandwiched between the base hoop and the retained hoop. The retained hoop being releasably attached to the hoop retaining means of the plunger head, once the cloth has been sandwiched between the hoops, the retaining means by moving slightly upwardly releases the inner or retained hoop. Thereafter continued upward movement causes the pretension member to be lifted from the cloth and also the framed cloth can then be removed for embroidering or other operations.

DETAILED DESCRIPTION OF THE DRAWINGS

Figure 2:
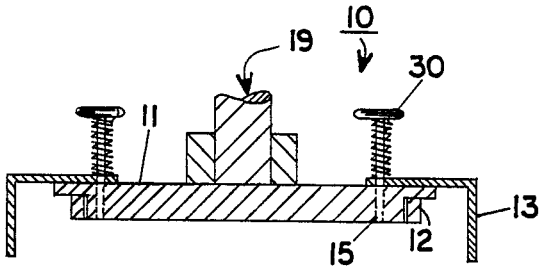
FIG. 2 shows the plunger head of FIG. 1 in a cross sectional view along lines 2—2 of FIG. 1.
Figure 3:
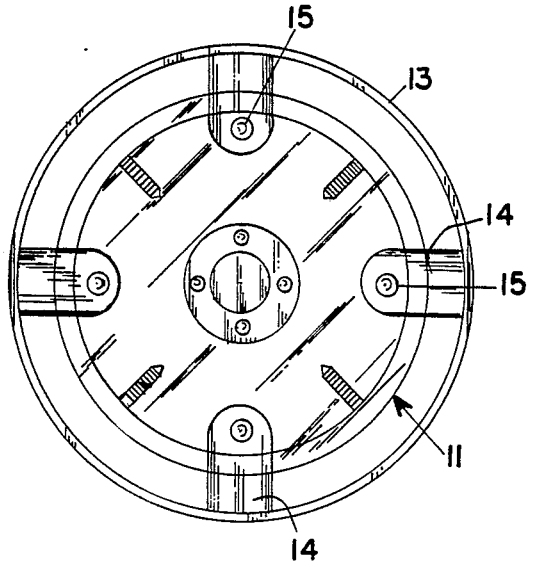
FIG. 3 illustrates a bottom plan view of the plunger head of FIG. 1.
Figure 4:
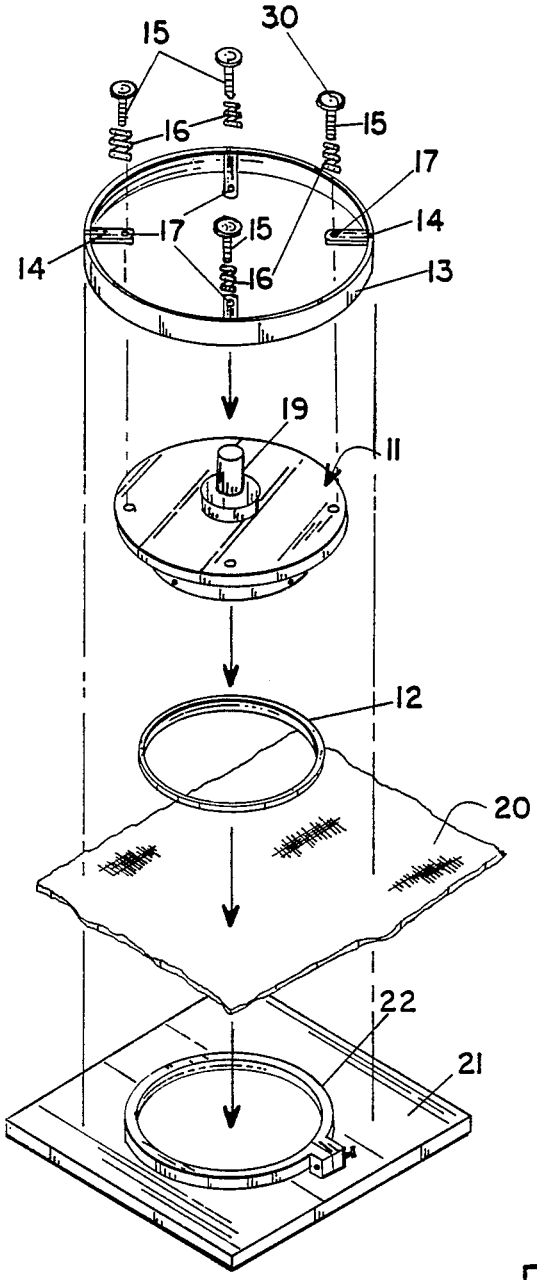
FIG. 4 depicts a framing operation utilizing the invention in exploded fashion.

Turning now to the drawings, as shown in FIG. 1, plunger head 10 is seen which can be used by affixing it to a plunger of a conventional embroidery frame press which may be, for example, foot activated. It is understood that plunger head 10 can be used manually and may be adapted to various automated or mechanical plungers as required. Plunger head 10 includes hoop retaining means 11 which has a circular shape for retaining hoop 12 as seen in FIGS. 2 and 4. Hoop 12 is the inner hoop in the illustrations herein presented although modifications could be made whereby the retained hoop comprises the outer hoop. FIG. 3 shows a bottom view of transparent hoop retaining means 11 formed from a polycarbonate material.

Pretension member 13 as seen in FIG. 1 has a substantially annular configuration although other types and shapes can be utilized depending on various factors including the particular cloth area to be framed. For example, a substantially rectangular frame of cloth may be desired for a work jacket section and the hoop retaining means and pretension member in that case would be substantially rectangularly shaped.

Pretension member 13 as shown in FIG. 1 is joined to hoop retaining means 11 by mounting tabs 14 which are radial projections having stud-receiving apertures 17 as seen in FIG. 4. Pretension member 13 and mounting tabs 14 may be formed from suitable metals such as steel or aluminum or may be molded from plastics or other synthetic materials depending on the size and durability characteristics desired. As shown in FIG. 4, mounting studs 15 pass through coil springs 16 and through apertures 17 of mounting tabs 14 where they are threadably received in retaining means openings 18. As mounting studs 15 are threaded, more or less tension can be applied to coil springs 16 to provide the resiliently desired between pretension member 13 and hoop retaining means 11, depending on the particular pressure required to accommodate the specific hoop configuration, cloth thickness or type, and press utilized. Studs 15 include spring stop means 30 at the upper end thereto which may be rigidly affixed to or adjustably positionable along stud 15.

FIG. 4 demonstrates cut-away plunger 19 affixed to hoop retaining means 11 for use on a conventional embroidery frame press although as earlier mentioned plunger head 10 may be utilized in a manual operation. As further shown in FIG. 4 cloth 20 which may be a portion of a shirt, jacket or other apparel or material is positioned on work table 21 which provides by an indention or otherwise, the stable placement of outer hoop 22. As further demonstrated, a schematic version of certain components used during cloth framing is shown in FIG. 4 and this illustration is not intended to picture a complete cloth framing operation. Work table 21 is shown only in partial fashion and may be sized and shaped to accommodate t-shirts, jackets or other garments or pieces as required.

Figure 5:
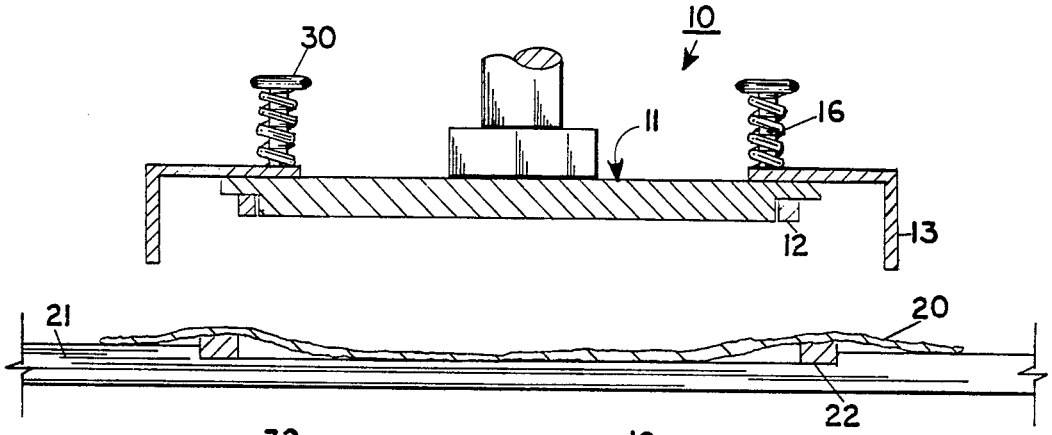
FIG. 5 shows the plunger head of the invention prior to contact with the base hoop.
Figure 6:
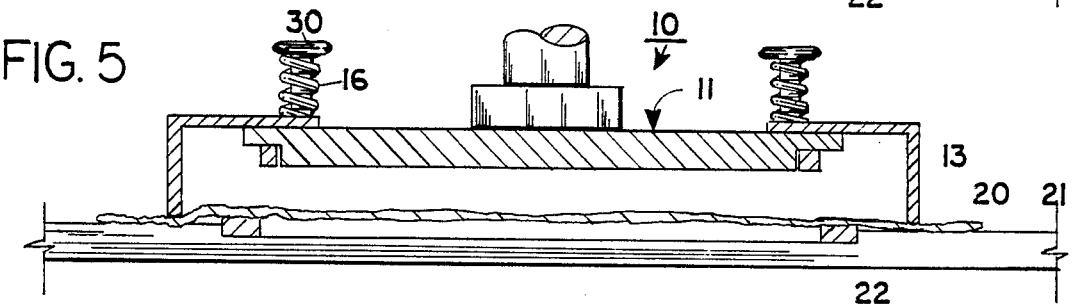
FIG. 6 pictures the pretension member holding the cloth prior to interlocking by the hoops.
Figure 7:
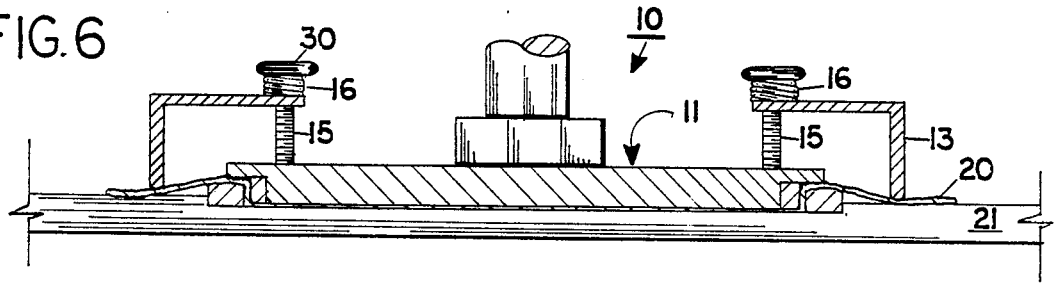
FIG. 7 demonstrates the plunger head in full descent with the hoops interlocked and the frame of cloth formed.
Figure 8:
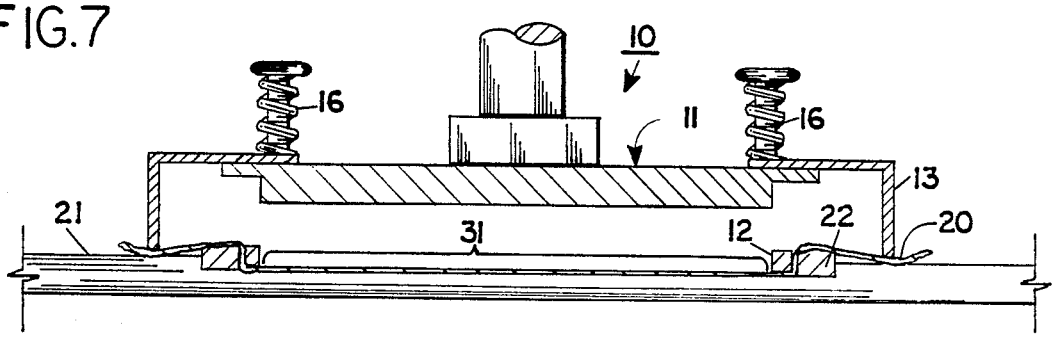
FIG. 8 illustrates the hoop retaining means lifted from frame of cloth but with the pretension member still in contact with the cloth immediately before said pretension member is lifted.

For a further, more complete understanding of the operation of the invention, FIG. 5 shows plunger head 10 in a downward path above cloth 20 and above base hoop 22. As seen, pretension member 13 extends vertically below the bottom of hoop 12 and hoop retaining means 11. Pretension member 13 holds cloth 20 tightly against the top surface of work table 21 as seen in FIG. 6. With the cloth so held hoop retaining means 11 then completes its downward movement as shown in FIG. 7 and cloth 20 is forced by inner hoop 12 through outer or base hoop 22 and is sandwiched between inner hoop 12 and outer hoop 22 providing a tighter, more uniform area of cloth 31 for embroidering than previously acheived by prior art devices and methods. FIG. 8 shows plunger head 10 with hoop retaining means 11 lifted from cloth 20, immediately before pretension member 13 is lifted.

During the framing operation, the operator can view cloth area 31 to be framed through transparent hoop retaining means 11 which is formed from a polycarbonate, acrylic or other suitable transparent materials.

By utilizing the present invention, a method of framing cloth between hoops for embroidering or other purposes allows the cloth to be placed over a base hoop 22 as seen in FIG. 5 within work table 21 and by gripping cloth 20 with pretension member 13 which is resiliently attached to plunger head 10, pretension member 13 applies initial pressure and stability to cloth 20 as seen in FIG. 6. Thereafter, as hoop retaining means 11 continues its final downward descent, inner hoop 12 is urged into engagement with outer hoop 22 whereby tension on cloth 20 is increased and a tighter, more uniform frame of cloth is available for embroidering or other subsequent operations. Once hoop retaining means 11 reaches its maximum downward position with both inner hoop 12 and outer hoop 22 being substantially concentric, retaining means 11 then moves vertically upwardly and due to the tenacious frictional engagement of inner hoop 12 with cloth 20, which is sandwiched between hoops 12 and 22, and due to pretension member gripping cloth 20, hoop retaining means 11 releases inner hoop 12. Upon further upward movement, pretension member 13 is withdrawn from cloth 20 and a frame of cloth is so formed for a subsequent operation.

Modifications can be made to the invention herein without departing from its intended scope and the illustrations and drawings provided are merely for explanatory purposes and are not intended to limit the scope of the appended claims.

I claim:

1. A plunger head comprising: hoop retaining means and a pretension member, said pretension member resiliently attached to said hoop retaining means.

2. A plunger head as claimed in claim 1 wherein said pretension member has a substantially annular configuration.

3. A plunger head as claimed in claim 1 wherein pretension member includes a mounting tab.

4. A plunger head as claimed in claim 1 wherein said hoop retaining means includes a mounting stud.

5. A plunger head as claimed in claim 4 and including a spring, said spring positioned on said stud.

6. A plunger head comprising a hoop retaining means and a pretension member, said pretension member adjustably mounted to said hoop retaining means.

7. A plunger head for framing cloth by sandwiching cloth tightly between a first and second hoop for embroidering thereon comprising: a hoop retaining means, said hoop retaining means including a plurality of mounting studs, a plurality of coil springs, said coil springs positioned on said mounting studs, a pretension member, said pretension member having a plurality of mounting tabs, each of said tabs defining an aperture, said tabs for positioning on said studs and resting on said coil springs with said studs penetrating said tab apertures to provide resilient attachment, spring stop means, said stop means positioned on said studs for controlling the movement of said tabs along said studs by adjustably positioning said stop means from said tabs, said pretension member extending below said hoop retaining means whereby said pretension member contacts the cloth prior to contact with said hoop retaining means to grip the cloth in a steady, tensioned manner prior to sandwiching the cloth between the first and second hoop.

8. A plunger head for framing an area of cloth for embroidering thereon, said plunger head for retaining a first embroidery hoop for engagment with a second embroidery hoop whereby cloth is sandwiched therebetween, the improvement comprising:

(a) a pretension member, said pretension member resiliently positioned on said plunger head whereby the pretension member grips the cloth and holds it steady prior to the first hoop contacting the cloth during framing.

9. A plunger head as claimed in claim 8 and including a transparent hoop retaining means.

10. A plunger head as claimed in claim 8 whereby a portion of said plunger head is formed from a transparent material.

* * * * *